United States Patent [19]

Hunter

[11] Patent Number: 4,590,982

[45] Date of Patent: May 27, 1986

[54] AUTOMATIC CORE SETTING MACHINE

[76] Inventor: William A. Hunter, 675 Aberdeen Rd., Inverness, Ill. 60067

[21] Appl. No.: 680,478

[22] Filed: Dec. 11, 1984

[51] Int. Cl.[4] ..... B22D 33/04

[52] U.S. Cl. ..... 164/253; 164/340

[58] Field of Search ..... 164/30, 137, 253, 340, 164/370, 397

[56] References Cited

U.S. PATENT DOCUMENTS 3,424,229 1/1969 Gunnergaard-Poulsen ..... 164/137
4,079,774 3/1978 Gunnergaard et al. ..... 164/340

FOREIGN PATENT DOCUMENTS 57-159237 10/1982 Japan ..... 164/30

OTHER PUBLICATIONS

"Coresetters Developed for Automatic Molding Machines", Modern Casting, May 1984, p. 45.
Beardsley & Piper Advertisement.

*Primary Examiner*—Nicholas P. Godici
*Assistant Examiner*—Richard K. Seidel

[57] ABSTRACT

A mask having pockets for holding foundry cores is swung downwardly and laterally from a core receiving position to a presetting position and then is lowered vertically to set the cores into the cavities of a sand mold. When the mask is in its receiving position, the top of the mask is tilted downwardly towards the mold and the pockets face outwardly to facilitate easy loading of the cores into the pockets without the application of vacuum. As the mask is swung downwardly and inwardly, it is turned to cause the pockets and cores to face downwardly (with the application of vacuum) preparatory to the cores being lowered vertically into the mold cavities.

8 Claims, 7 Drawing Figures

AUTOMATIC CORE SETTING MACHINE

BACKGROUND OF THE INVENTION

This invention relates to a machine for automatically placing cores in the cavities of sand molds.

An automatic core setting machine is disclosed in Gunnergaard et al U.S. Pat. No. 4,079,774. In that machine, the cores are carried in pockets in a mask which picks the cores up from a core making machine and places the cores in the molds. Typically, the cores are held in the mask by applying vacuum to the pockets as disclosed in the Gunnergaard et al patent.

SUMMARY OF THE INVENTION

The general aim of the present invention is to provide an automatic core setter which is capable of high speed operation, which may be loaded quickly and conveniently and which occupies comparatively little floor space.

A more detailed object of the invention is to achieve the foregoing by providing a core setter in which the mask is swung downwardly and laterally through a short arc from a core receiving position to a presetting position and then is lowered vertically to place the cores in the mold. When the mask is in its receiving position, it is located at about shoulder level and its pockets face away from the mold station to enable the cores to be loaded easily into the pockets from the side of the machine. As an incident to being swung downwardly and toward the mold, the mask is automatically turned to bring the cores into a downwardly facing position for downward insertion into the mold.

The invention also resides in the unique inclined orientation of the mask at the core receiving position to enable cores placed in the pockets to be retained therein without applying vacuum to the pockets at the receiving position.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3:
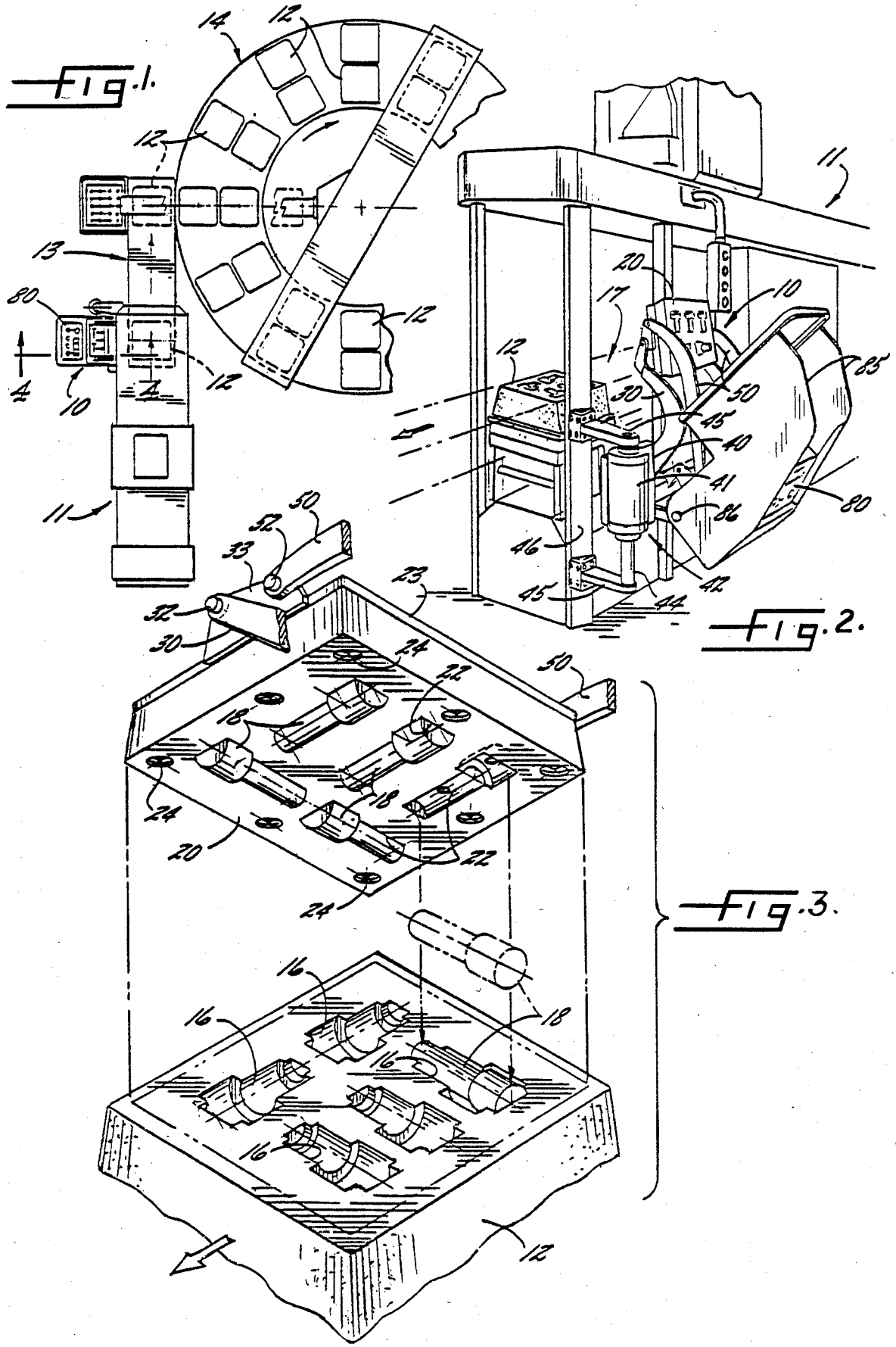
FIG. 1 is a diagrammatic top plan view showing an automatic molding machine in working relationship with a mold handling table and equipped with a new and improved automatic core setter incorporating the unique features of the present invention.
FIG. 2 is a perspective view showing the core setter and part of the molding machine.
FIG. 3 is a perspective view showing the mask of the core setter located above a typical mold.

For purposes of illustration, the core setting machine 10 of the present invention is shown in conjunction with an automated mold handling system having an automatic matchplate molding machine 11 for making green sand molds 12 and having a self-storing conveyor 13 for feeding the molds to a rotary mold handling table 14 on which the molds are weighted, poured and cooled. Reference may be made to Hunter U.S. Pat. No. 3,406,738 for a detailed disclosure of a matchplate molding machine and to Hunter U.S. Pat. No. 3,703,921 for a detailed disclosure of a mold handling table.

Herein, each mold 12 has been shown as having been formed with five upwardly opening mold cavities 16 (FIG. 3). When the mold dwells at a core setting station 17, the core setting machine 10 of the present invention places cores 18 in the cavities. The core setter 10 includes a block-like holder or mask 20 having a flat side which is formed with five pockets 22 (FIG. 3) for receiving the cores. The opposite side of the mask is covered by a mounting plate 23 which is attached releasably to the mask by bolts 24 (FIG. 5) and which coacts with the mask to define a vacuum manifold 25 having branches opening into the pockets 22. A vacuum pump 27 is carried by the plate 23 and, when activated, draws a vacuum at each of the pockets to hold the cores 18 in the pockets.

In accordance with the present invention, the mask 20 of the core setter 10 is adapted to be loaded with cores 18 while oriented with the pockets 22 conveniently facing away from the mold and while located in an easy-to-reach core receiving position (FIG. 4) spaced upwardly and laterally spaced from the mold 12 in the core setting station 17. After being loaded, the mask 20 is swung downwardly and laterally toward the mold through a relatively short arc and, at the same time, is turned so as to cause the cores to face downwardly preparatory to the mask arriving at a presetting position directly above the mold as shown in full lines in FIG. 5. Thereafter, the mask is shifted straight downwardly as shown in phantom lines in FIG. 5 to insert the cores into the mold cavities 16 with a straight-down positive placement action. This arrangement enables the machine operator to load the mask easily and conveniently, effects high speed positive placement of the cores and takes up relatively little floor space in the lateral direction.

More specifically, the mask 20 is supported for swinging movement between its receiving position and its presetting position by a pair of curved swing arms 30 (FIGS. 4 and 6) mounted for pivoting movement parallel to each other and tied together by a cross beam 31. The upper end portions of the arms 30 straddle the mask 20 and are pivotally connected by horizontally extending pins 32 to a pair of ears 33 projecting from the mounting plate 23.

At their lower ends, the swing arms 30 are pivotally connected at 35 (FIG. 4) to ears 36 projecting laterally from a beam 37 adapted to be moved vertically with linear motion to cause the mask 20 to shift downwardly from its presetting position and place the cores 18 in the mold 12. For this purpose, one end of the beam 37 is connected rigidly by a bracket 40 to the cylinder 41 of a vertically extending hydraulic actuator 42 having a piston 43 (FIG. 6) disposed slidably within the cylinder and having a rod 44 extending out of the ends of the cylinder. The rod is fixed in a stationary position by a pair of mounting brackets 45 anchored to the main frame 46 of the molding machine 13. Thus, pressure fluid admitted into the cylinder 41 acts against the fixed piston 43 to cause the cylinder to move vertically on the rod 44 and thereby to effect vertical movement of the beam 37, the arms 30 and the mask 20.

Figure 4:
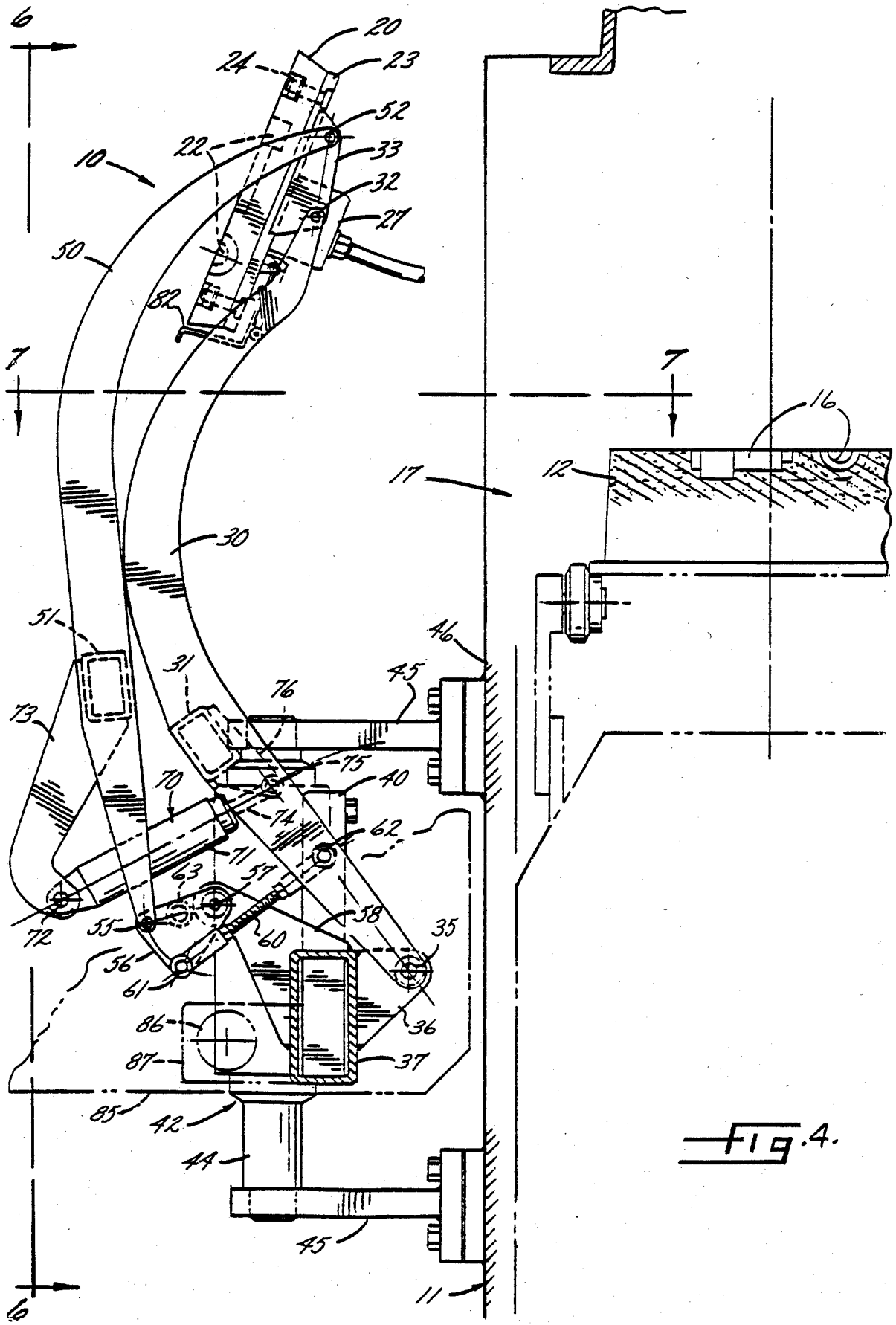
FIG. 4 is an enlarged fragmentary cross-section taken substantially along the line 4—4 of FIG. 1 and shows the mask in a core receiving position.
Figure 6:
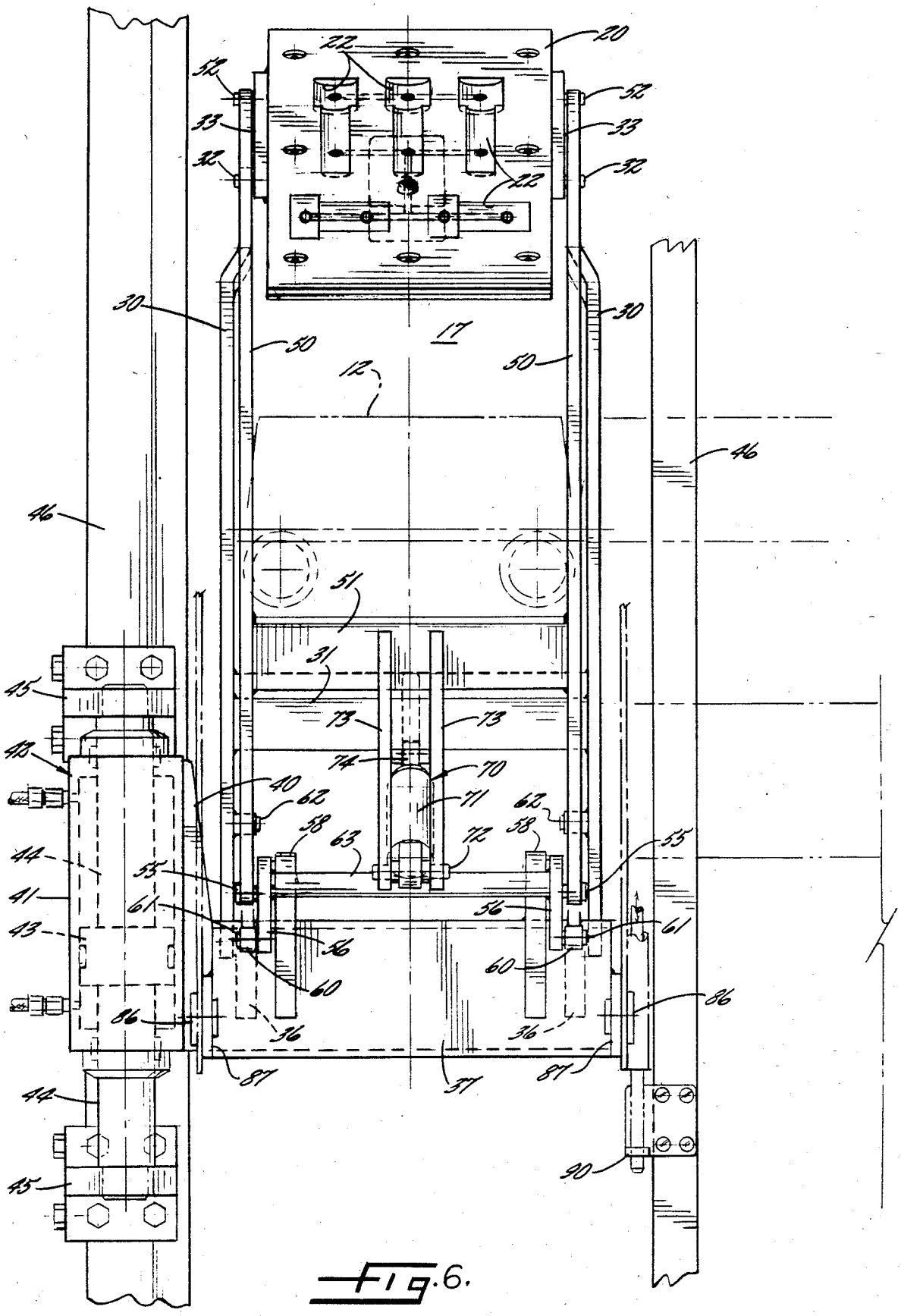
FIGS. 6 and 7 are fragmentary views taken substantially along the lines 6—6 and 7—7, respectively, of FIG. 4.
Figure 7:
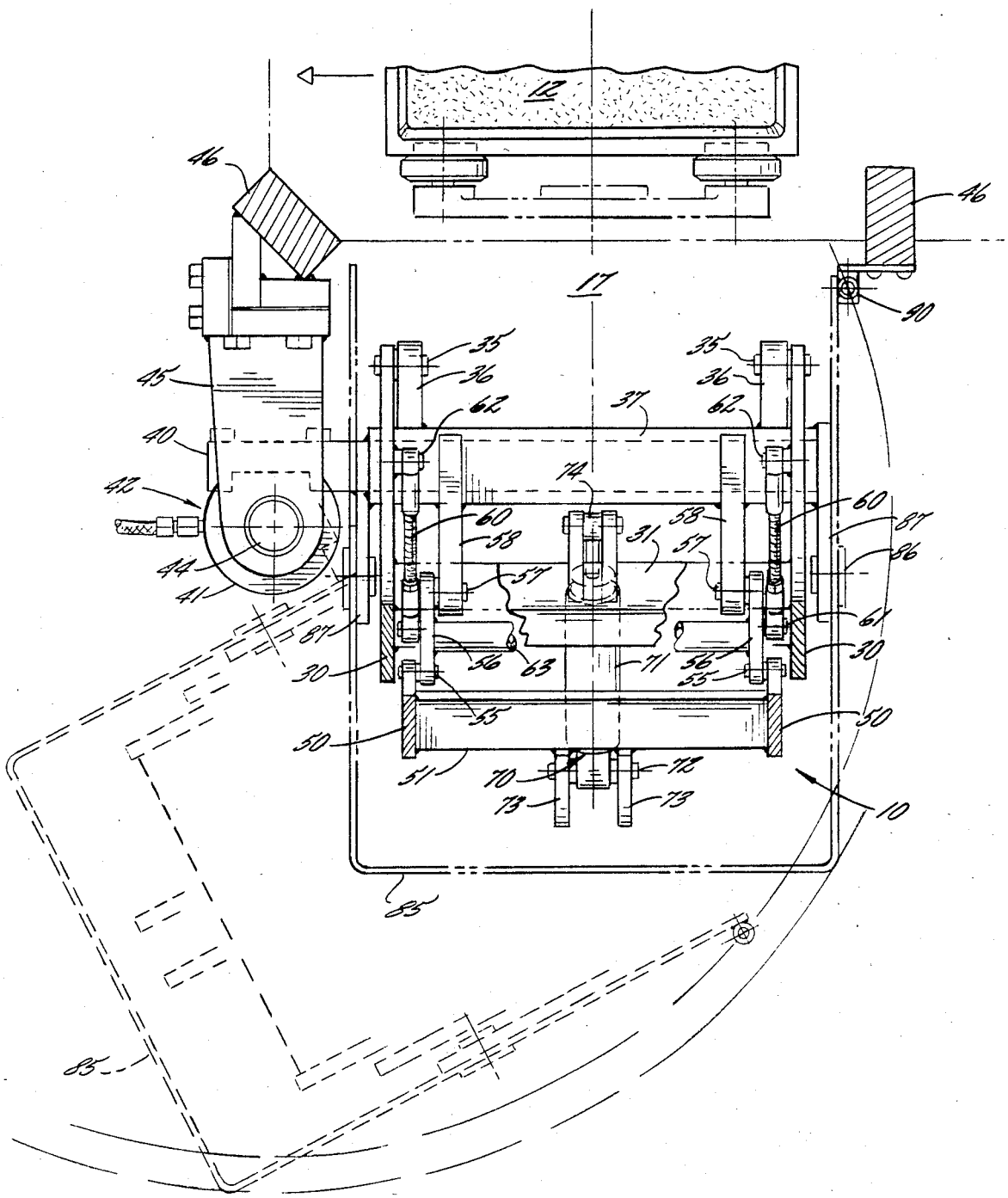

When the mask 20 is disposed in its core receiving position shown in FIG. 4, the face of the mask slants downwardly away from the mold and is oriented such that its pockets 22 face outwardly to receive the cores 18. As the mask is swung downwardly toward the mold 12 by the arms 30, it is turned relative to the arms about the axes of the pins 32 to cause the cores to face downwardly for insertion into the mold 12 (see FIG. 5). To turn the mask about the pins 32, two additional curved arms 50 (FIG. 4) connected by a cross beam 51 are pivotally connected to the ears 33 by pins 52 which extend parallel to the pins 32. The lower ends of the arms 50 are pivotally connected at 55 to a pair of bellcranks 56 which, in turn, are pivotally connected at 57 to ears 58 projecting outwardly from the beam 37. Lengthwise adjustable links 60 extend between the bellcranks 56 and the arms 30, the links being pivotally connected at 61 to the bellcranks and being pivotally connected at 62 to the arms 30. The bellcranks are connected rigidly to one another by a cross rod 63 (FIGS. 6 and 7).

Figure 5:
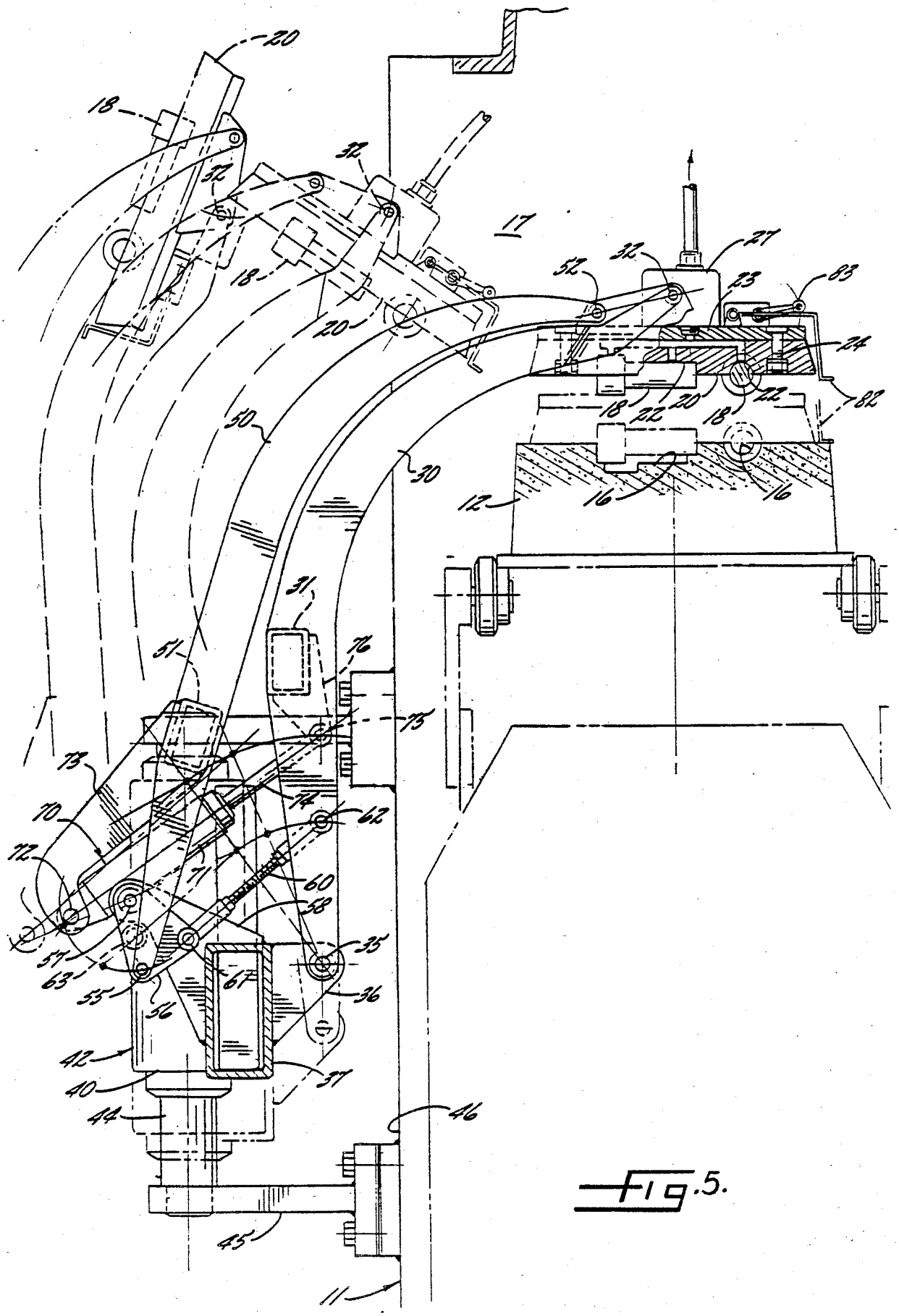
FIG. 5 is a cross-section similar to FIG. 4 but shows the mask just prior to placing the cores in the mold.

When the arms 30 swing clockwise to move the mask 20 downwardly and laterally from its receiving position (FIG. 4) to its presetting position (solid lines in FIG. 5), they act through the links 60 and the bellcranks 56 to turn the arms 50 through the series of moved positions shown in FIG. 5. In so turning, the arms 50 turn the mask 20 counterclockwise about the pins 32 from its laterally facing position to its downwardly facing position. Swinging of the arms 30 through approximately 55 degrees causes the arms 50 to turn the mask 20 through about 110 degrees about the pins 32.

Swinging of the arms 50 is effected by a hydraulic actuator 70 (FIG. 4) having a cylinder 71 connected pivotally at 72 to ears 73 extending downwardly from the beam 51. The rod 74 of the actuator 70 is pivotally connected at 75 to ears 76 extending downwardly from the beam 31.

When the mask 20 is located in its receiving position shown in FIG. 4, it is at about shoulder level and thus the operator of the machine 10 may conveniently load cores 18 into the outwardly facing pockets 22. Because the top of the mask is tilted downwardly toward the mold when in its receiving position, it is not necessary that the vacuum pump 27 be activated since the inclination of the mask keeps the cores from falling out of the pockets.

A core setting cycle is initiated by actuating a cycle start button on a control panel 80 (FIG. 2) to activate the vacuum pump 27 and to cause the actuator 70 to extend the rod 74. As the rod extends, the arms 30 swing clockwise about the pivot 35 to move the mask 20 downwardly and laterally toward the mold 12. At the same time the arms 30 act through the links 60 and the bellcranks 56 to cause the arms 50 to turn the mask 20 counterclockwise about the pins 32. When the rod 74 is fully extended, the mask 20 is positioned directly above the mold 12 and is oriented such that the cores 18 face downwardly. Pressure fluid then is admitted into the lower end of the cylinder 41 to cause the beam 37, the arms 30 and the mask 20 to move straight downwardly so that the mask places the cores 18 in the cavities 16 in the mold 12. As the mask completes its downward movement, a pivoted feeler 82 (FIG. 5) on the plate 23 engages the top of the mold and swings upwardly to trip a switch 83 and de-activate the vacuum pump 27. With the vacuum released, the cores remain in the cavities of the mold when the actuators 42 and 70 are sequentially reversed to return the mask to its receiving position.

The control panel 80 is mounted in the lower portion of a hood 85 (FIG. 2) which normally shields the sides of the arms 30 and 50 and the other movable components. The hood is pivotally mounted at 86 (FIG. 7) on ears 87 on the beam 37 and may be swung downwardly to an open position as shown in FIG. 2. In addition, the hood 85, the beam 37 and all components carried by the beam may be swung outwardly about the rod 44 of the actuator 42 for servicing, the cylinder 41 of the actuator being rotatably supported on the rod to permit such swinging. A suitable latching mechanism 90 on the frame 46 and the hood normally holds the hood in the closed position shown in FIG. 7 while permitting the hood to move upwardly and downwardly with the beam.

From the foregoing, it will be apparent that the present invention brings to the art a new and improved core setting machine 10 which occupies relatively little floor space in the lateral direction since the mask 20 and the arms 30 and 50 initially are in upright positions and are swung through a relatively short arc. The mask is easy to load as a result of its initial shoulder level location and outwardly facing orientation. Moreover, the machine may operate at relatively high speed and places the cores 18 into the mold 12 with a positive linear placement motion even though a swinging motion is used to bring the cores into proximity with the mold.

1. A machine for automatically placing a core into an upwardly facing cavity in a mold located in a core setting station, said machine comprising a holder selectively operable to retain and release a core, an arm mounting said holder to swing laterally about a generally horizontal first pivot axis between a receiving position spaced upwardly and laterally away from a mold dwelling in said core setting station and a presetting position spaced directly above said mold, said holder being supported to turn on the free end portion of said arm about a second and substantially parallel axis between a core receiving orientation and a core placing orientation, said holder being disposed in said core receiving orientation and facing laterally away from said mold when said holder is in said receiving position whereby a core may be loaded into said holder, means for swinging the loaded holder laterally toward said mold and downwardly about said first pivot axis from said receiving position to said presetting position, mechanism responsive to lateral and downward swinging of said holder about said first pivot axis to cause said holder to turn about said second pivot axis from said receiving orientation to said placing orientation, said holder being disposed in said placing orientation and facing downwardly when said holder is in said presetting position, actuator means for thereafter causing said holder to move downwardly along a substantially linear path to place the core in the cavity in said mold, and means for causing the holder to release the core into the cavity.

2. A machine as defined in claim 3 further including means for tilting the top of said holder downwardly toward the mold when said holder is in said core receiving orientation whereby a core placed in said holder will remain therein by gravity.

3. A machine as defined in claim 1 in which said turning mechanism comprises a second arm having a free end portion pivotally connected to said holder at a third pivot axis offset from and extending parallel to said second axis, and a linkage connected between said first and second arms and operable to cause said second arm to turn said holder about said second axis when said first arm is swung about said first axis.

4. A machine as defined in claim 3 in which said linkage comprises a bellcrank connected to said second arm and supported to turn about a fourth axis offset from and extending parallel to said other axes, and a link connected pivotally between said bellcrank and said first arm.

5. A machine as defined in claim 1 in which said swinging means comprise a reciprocating fluid-operated actuator having one end pivotally connected to said first arm and having an opposite end pivotally connected to said second arm.

6. A machine as defined in claim 1 further including a fixed frame, said arm being mounted for up and down linear movement on said frame, said actuator means comprising a reciprocating fluid-operated actuator operably connected between said frame and said arm.

7. A machine as defined in claim 6 in which said actuator comprises a rod secured to said frame, said actuator further comprising a cylinder connected to said arm and slidable upwardly and downwardly on said rod, said cylinder also being turnable on said rod to permit said arm and said holder to be swung outwardly from said frame.

8. A machine as defined in claim 1 in which said holder comprises a mask having a pocket for receiving said core, means for selectively creating a vacuum within said pocket to releasably hold the core therein, the top of said mask being tilted downwardly toward the mold when said mask is in said core receiving orientation whereby a core placed in said pocket will remain therein without the application of vacuum to said pocket.

* * * * *